United States Patent [19]

Lanahan

[11] 3,968,917

[45] July 13, 1976

[54] RECORD FEEDING APPARATUS AND METHOD

[75] Inventor: John H. Lanahan, Whitesboro, N.Y.

[73] Assignee: Monarch Marking Systems, Inc., Dayton, Ohio

[22] Filed: Dec. 30, 1974

[21] Appl. No.: 537,629

[52] U.S. Cl. ..... 226/2; 226/182; 226/196; 271/250

[51] Int. Cl.[2] ..... B65H 17/22

[58] Field of Search ..... 226/15, 17, 182, 196, 226/168; 26/54, 63; 271/250

[56] References Cited

UNITED STATES PATENTS

| | | | |
|---|---|---|---|
| 2,167,823 | 8/1939 | Backhouse | 271/250 |
| 3,166,651 | 1/1965 | Leimer | 226/182 UX |
| 3,494,525 | 2/1970 | Wiig | 226/196 X |
| 3,553,058 | 11/1967 | Good | 226/168 X |

*Primary Examiner*—Richard A. Schacher
*Attorney, Agent, or Firm*—Joseph J. Grass

[57] ABSTRACT

There is disclosed a method of feeding record webs or sheets and apparatus for carrying out the method. The record feeding apparatus is shown in conjunction with a printing apparatus having a print head assembly, platen structure, a mechanism for severing a printed record from the remainder of the record and an inking mechanism. The record feeding apparatus includes an edge guide, a rotatable feed wheel having a planar frictional surface which engages one face of the web to exert a resultant drive force on the record when driven, the resultant force being comprised of a force vector of large magnitude extending in the longitudinal direction for feeding the record longitudinally and a force vector of small magnitude extending in the lateral direction for causing the record to be driven laterally to cause its side edge to be in guided contact with the edge guide. A roll cooperates with the frictional surface to provide a pinch point disposed either upstream longitudinally of the rotational axis and laterally between the rotational axis and the edge guide or downstream longitudinally of the rotational axis and laterally beyond the rotational axis.

18 Claims, 7 Drawing Figures

FIG-2
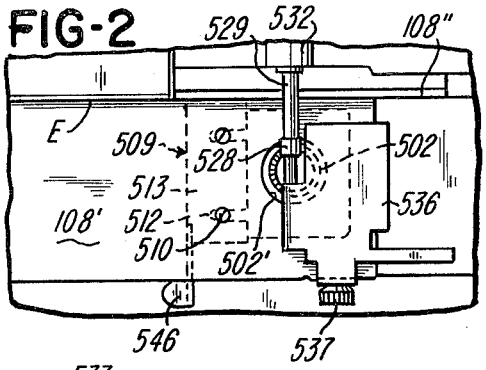
FIG-3
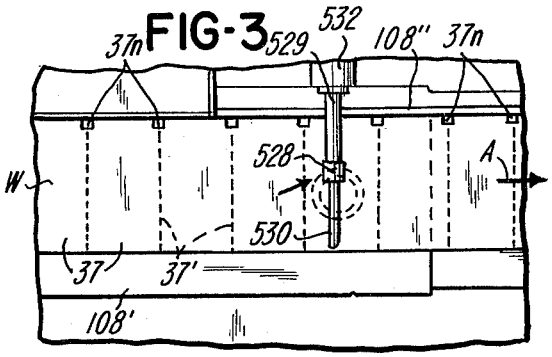
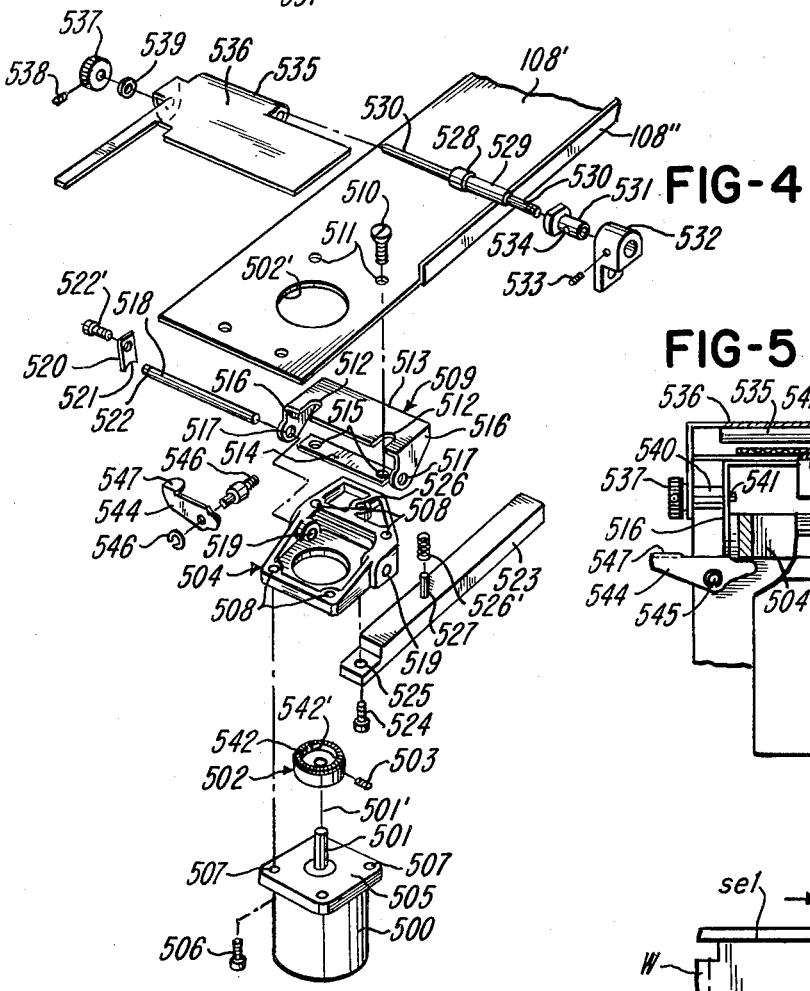
FIG-4
FIG-5
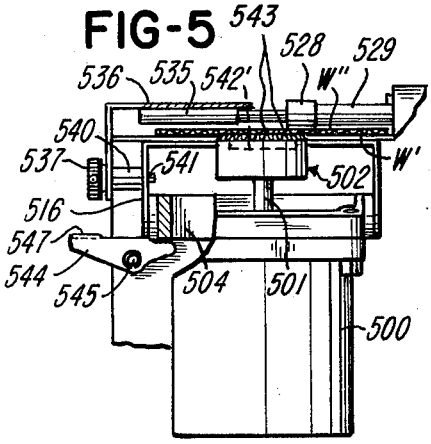
FIG-6
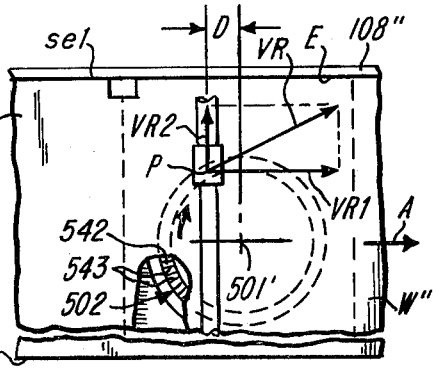
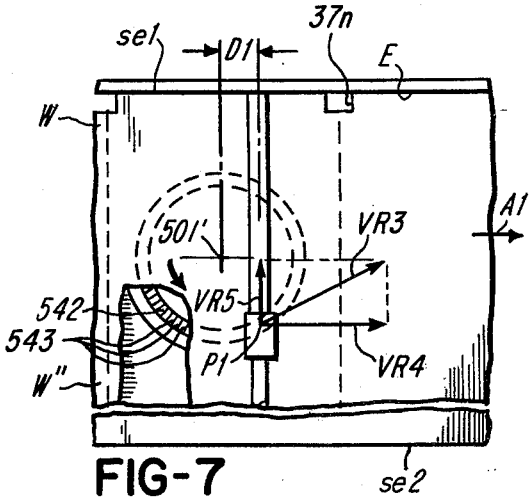
FIG-7

RECORD FEEDING APPARATUS AND METHOD

BACKGROUND OF THE INVENTION

1. Field of the Invention

This invention relates to record feeding apparatus and methods.

2. Brief Description of the Prior Art

Prior art U.S. patents to Martin, No. 2,300,625 and Masterson et al, U.S. Pat. No. 3,350,091 relate to apparatus for feeding sheets longitudinally while being guided at a side edge by an edge or side guide. Apparatus of this type generally involve a considerable number of parts, gears or pulleys and a special arrangement of bearings.

SUMMARY OF THE INVENTION

The invention is directed to method and apparatus for feeding record webs or sheets. A method in accordance with the invention accomplishes the feeding of a longitudinally extending record having opposite faces terminating at side edges. The steps of the method comprise providing an edge guide, providing a rotatable feed wheel having a rotational axis and having a frictional surface rotatable in a plane generally perpendicular to the rotational axis, and bringing the record between a pinch point provided by the frictional surface and a rotatable roll and rotating the feed wheel to feed the record longitudinally in guided relationship with the edge guide; the pinch point being disposed either upstream longitudinally of the rotational axis and laterally between the rotational axis and the edge guide or downstream longitudinally of the rotational axis and laterally beyond the rotational axis. More particularly, a specific embodiment of the method includes positioning the feed wheel so that the frictional surface of the feed wheel is in contact with a face of the record while the rotational axis of the feed wheel is generally perpendicular to the face of the record to exert a resultant drive force on the web while the feed wheel is being driven comprised of a force vector of large magnitude extending in the longitudinal direction for feeding the record longitudinally and a force vector of small magnitude extending in the lateral direction for driving the record laterally to cause its side edge to be in guided contact with the edge guide with concomitant slippage between the frictional surface and the face of the web to prevent the record from buckling laterally. A specific embodiment of apparatus for carrying out the method comprises a rotatable feed wheel preferably arranged as described above, a stepping motor having a drive shaft to which the feed wheel is secured, a guide plate on which the record is fed to the printing and severing mechanisms, a cutout in the plate in which the feed wheel is rotatably mounted, a roll preferably disposed as indicated above, means mounting the motor and hence the feed wheel for movement toward and away from the roll specifically including a pivot, a counterweight for balancing the weight of the motor and feed wheel, and a spring for causing the feed wheel to be urged toward the roll. Arranging the feed wheel in the manner indicated provides for a compact arrangement of parts and direct drive by the stepping motor without any need for gears, pulleys, additional bearings or the like.

BRIEF DESCRIPTION OF THE DRAWINGS

FIG. 2 is a top plan view of a fragmentary portion of the platen assembly showing a portion of the record feeding apparatus with a hold-down plate;

FIG. 3 is a view similar to FIG. 2 showing a record web in position to be fed by the record feeding apparatus, but omitting the hold-down plate;

FIG. 4 is an exploded perspective view of the record feeding apparatus;

FIG. 5 is a lateral sectional view of the record feeding apparatus in its assembled condition;

FIG. 6 is an enlarged top plan view similar to FIG. 3, but showing the feed wheel positioned exaggeratedly relative to the roll for the sake of clarity; and FIG. 7 is an enlarged top plan view of an alternative embodiment similar to FIG. 6 but showing the feed wheel and the roll positioned differently relative to each other.

DETAILED DESCRIPTION OF THE PREFERRED EMBODIMENTS

Figure 1:
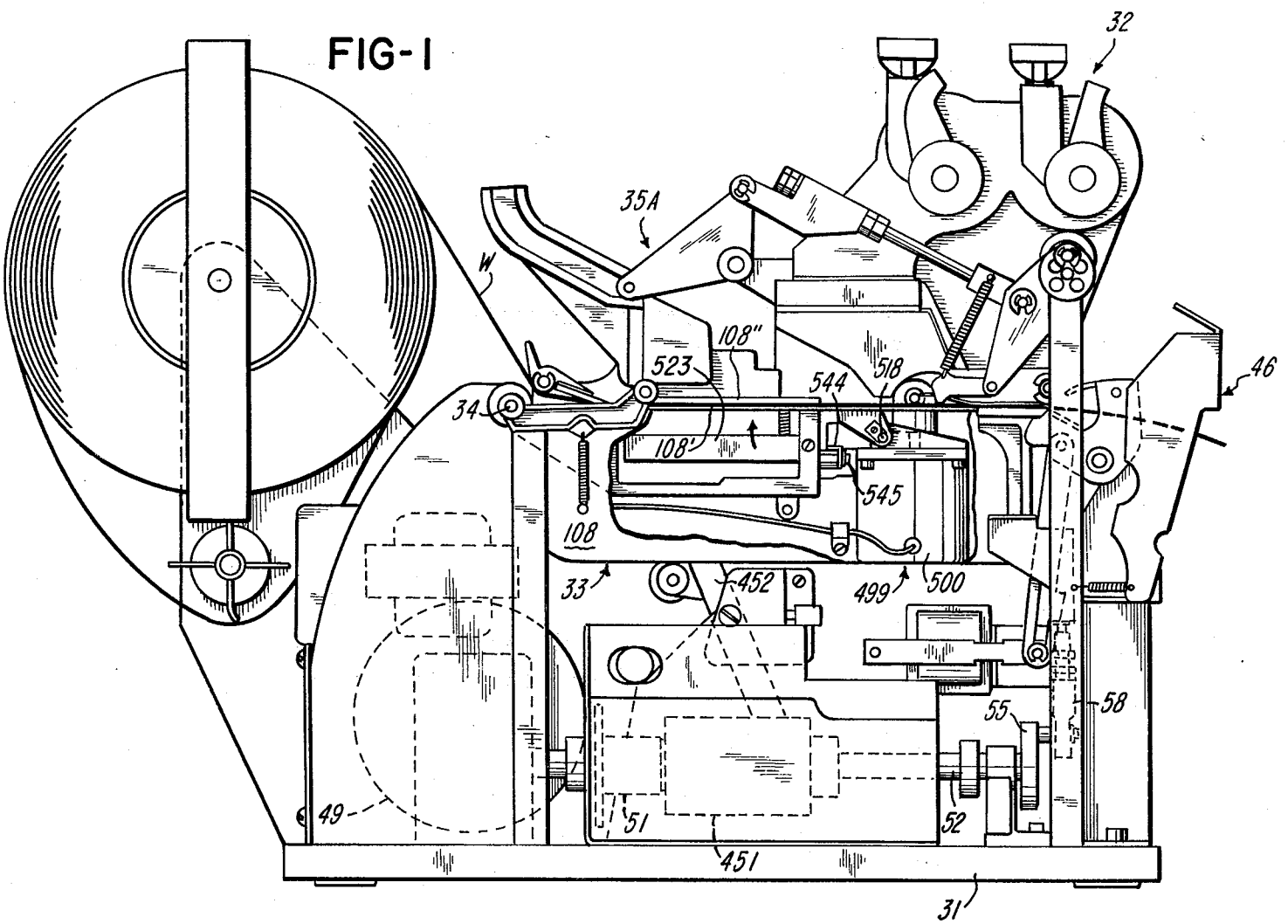
FIG. 1 is a side elevational view of a printing apparatus incorporating the record feeding apparatus of the invention.

With reference to FIG. 1, there is shown the record feeding apparatus generally indicated at 499 adapted for operation with the printing apparatus disclosed in U.S. Pat. No. 3,767,098 to Robert M. Pabodie. The entire disclosure of U.S. Pat. No. 3,767,098 is incorporated herein by reference. Accordingly, the same reference characters are used in the present application as were used in U.S. Pat. No. 3,767,098 to designate like components.

The drawings of the present application show the record feeding apparatus 499 as feeding a web of records. Consequently, the specification makes reference to the web, but it is to be understood that the invention is also applicable to the feeding of the sheets. Accordingly, the invention is not to be limited to feeding webs but also includes the feeding of sheets. Thus, the expression "record" as used in the present application includes both webs and sheets.

With reference to FIG. 1 there is shown a frame 31 to which a print head assembly 32 is fixedly mounted. An inking mechanism 35A is used to ink the print head assembly 32. An electric motor 49 selectively drives a drive shaft 52 through a clutch 51. The drive shaft 52 drives a crank 55 which in turn drives a connecting rod 58. A platen assembly 33 pivotally mounted by a pin 34 is driven alternately toward and away from the print head assembly 32 by the connecting rod 58. A severing mechanism 46 is used to sever record members 37 from the web W. A barrel cam 451 drives the inking mechanism 35A through an arm 452. The platen assembly 33 is provided with a guide plate 108' on which the web W is guided to the print head assembly 32 and the severing mechanism 46. The platen assembly 33 is provided with a platen frame 108 of which the plate 108' can be considered to be a part. A plate 108'' secured to the plate 108' provides an edge guide for the web W.

With reference to FIG. 4 there is shown a stepping motor 500 having a drive shaft 501. A feed wheel generally indicated at 502 is suitably secured to the drive shaft 501 as by a set screw 503. The feed wheel 502 is rotatable in an enlarged hole 502' in the plate 108'. The motor 500 is secured to a motor mount 504. The motor 500 has a flange 505. Screws 506 (only one of which is shown in FIG. 4) pass through four holes 507 (only three of which are shown) and are received in threaded holes 508 in the motor mount 504. A bracket 509 is secured to the plate 108' by screws 510 (only one of which is shown). The screws 510 extend through holes 511 in the plate 108' and extend through cutouts 512 in the bight portion 513 of the bracket 509. A nut plate 514 has threaded holes 515 which receive the respective screws 510. The nut plate 514 clamps the bight portion 513 against the underside of the plate 108'. The bracket 509 includes depending arms 516 joined to the bight portion 513. The arms 516 have respective holes 517 for receiving a pivot pin 518. The pivot pin 518 passes through holes 519 in the motor mount 504 and is received in the holes 517. Accordingly, the pivot pin 518 and the bracket 509 mount the motor mount 504 and hence the motor 500 and the feed wheel 502 which it carries for pivotal movement. The pivot pin 518 is held in position by a retainer 520, the curved end 521 of which is received in an annular groove 522 on the outer surface of the pivot pin 518. A screw 522' is threadably received by the arm 516 at the left side of the bracket 509 as viewed in FIG. 4.

A counterweight 523 is secured to the underside of the motor mount 504 by a screw 524 which passes through a hole 525 and is threadably received in a threaded hole 526 in the motor mount 504. As best seen in FIG. 1, most of the mass to be counterbalanced resides in portion the stepping motor 500 which is disposed to the right of the pivot pin 518. The counterweight 523 is relatively long and essentially counterbalances all of the mass disposed to the right of the pivot pin 518 as viewed in FIG. 1. FIG. 1 shows the platen assembly 33 in its upward position so that one of the record members 37, defined by lines of partial severing 37', is in printing cooperation with the print head assembly 32. It will be appreciated that as the platen assembly 33 pivots downwardly away from that position, the amount of the mass required to be counterbalanced decreases which means that the feed wheel 502 will exert a greater upward force against the underside of the web W. However, this increase in force is slight and is well within the range of maximum desired for this purpose. A compression spring 526' received on a post 527 secured to the counterweight 523 exerts a downward force on the counterweight and an opposite upward force on the underside of the plate 108'. The purpose of the spring 526 is to insure that there is always adequate force being applied by the feed wheel 502 to the underside of the web W and to compensate for any bounce that may result when the platen assembly 33 starts and stops during the printing cycle.

A roll 528 is a back-up member or needle bearing mounted on the shaft 530. The one marginal end of the shaft 530 is received in a bushing 531 received in a bracket 532. The bracket 532 is suitably secured to the platen frame 108. A set screw 533 is threaded into the bracket 532 and extends through a hole 534 in the bushing 531 and bears against the shaft 530. The other end of the shaft 530 is received by a rolled end 535 of a web hold-down plate 536. The plate 536 is locked to the one arm 516 by a retainer 537 and a set screw 538. The retainer 537 and a washer 539 are received by a stud 540 having a threaded end 541 received in one depending arm 516. The feed wheel 502 is shown to have a frictional surface generally indicated at 542. The frictional surface 542 is more specifically shown to comprise an annular ring having a multiplicity of small serrations 543 which extend in a radial direction as best shown in FIG. 6. The portion of the wheel 502 within the annular ring is recessed as indicated at 542'. Axis 501' of the shaft 501 is also the rotational axis of the feed wheel 502. It is apparent that the frictional surface 542 rotates in a plane that is perpendicular to the axis 501'. It is also apparent from FIG. 6 that the plane in which the frictional surface 542 rotates is parallel to face W' of the web W. The web W is disposed between the feed wheel 502 and the roll 528. More particularly the roll 528 exerts pressure against the other face W'' of the web W in opposition to the force exerted by the frictional surface 542 at the pinch point P.

The web W is fed in the direction of arrow A as shown in FIGS. 3 and 6 in the downstream direction. As best shown in FIG. 6 the pinch point P is disposed upstream of the rotational axis 501' by a distance D. In addition the pinch point P is disposed laterally between the rotational axis 501' and edge E of the guide 108''. The resultant force indicated by vector VR is comprised of a force vector VR1 of large magnitude extending in the longitudinal direction for feeding the web longitudinally and a force vector VR2 of small magnitude extending in the lateral direction for driving the web W laterally to cause its side edge se1 to be in contact with edge E with concomitant slippage between the frictional surface 542 and the side W' of the web W to prevent the web from buckling laterally. The force vector VR extends tangentially to the frictional surface 542 of the wheel 502. Although shown exaggerated in FIG. 6, the force vector VR2 is very small compared to the force vector VR1. Nevertheless, if there were no slippage between the frictional surface 542 and the web W, the web would buckle some laterally between the pinch point P and the side edge se1 of the web W. In that the vector VR2 is relatively small and the web W which is comprised of tag stock is relatively stiff and because of the small amount of slippage that takes place, the side edge se1 of the web W is always in contact with and guided by the edge E of the guide 108'' as the web W is driven in the direction of arrow A.

In order to facilitate threading of the web W through the printing apparatus and specifically to facilitate insertion in the web W between feed wheel 502 and the roll 528 during the threading process, there is provided a lever 544 which is pivotally mounted on a pivot pin 545. The pivot pin 545 is secured to the frame 108 by a threaded portion 546. The lever 544 is held on the pivot pin 545 by a retainer 546. The lever 544 has a manually engageable surface or button 547. As viewed in FIG. 5, depressing the button 547 pivots the lever 544 counterclockwise in that the lever contacts the motor mount 504, the motor mount 504 and the motor 500 and the feed wheel 502 which it pivots clockwise (FIG. 1) about the pivot pins 518. With the button 547 held depressed the feed wheel 502 is away from the roll 528 sufficiently to allow the free end of the web W to be easily inserted between the feed wheel 502 and the roll 528. Once this has been accomplished the button 547 can be released and the counterweight 523 and the spring 526 will urge the surface 542 of the wheel 502 into pressure contact with face W'. In that the pinching force exerted on the web W at the pinch point P is high relative to the force exerted by the frictional surface 542 on the face W' at other than the pinch point P, almost all the driving force transmitted to the web W takes place at the pinch point P. The forces transmitted to the web W by the frictional surface 542 at other than the pinch point P do not interfere with reliable feeding of the web W. The pinch point P is not a finite point but rather it is the area of the web which experiences the pressure exerted by the action of the frictional surface 542 and the roll 528.

In the embodiment of FIG. 7, the web W is fed in the downstream direction indicated by arrow A1. The pinch point P1 is disposed downstream of the rotational axis 501' by a distance D1. In addition the pinch point P1 is disposed laterally beyond the rotational axis 501'. The resultant force indicated by vector VR3 is comprised of a force vector VR4 of large magnitude extending in the longitudinal direction for feeding the web longitudinally and a force vector VR5 of small magnitude extending in the lateral direction for driving the web W laterally to cause its side edge se1 to be in contact with edge E with concomitant slippage between the frictional surface 542 and the side W' of the web W to prevent the web from buckling laterally. The force vector VR3 extends tangentially to the frictional surface 542 of the wheel 502. Although shown exaggerated in FIG. 7, the force vector VR5 is very small compared to the force vector VR4. Nevertheless, if there were no slippage between the frictional surface 542 and the web W, the web would buckle some laterally between the pinch point P1 and the side edge se1 of the web W. In that the vector VR5 is relatively small and the web W which is comprised of tag stock is relatively stiff and because of the small amount of slippage that takes place, the side edge se1 of the web W is always in contact with and guided by the edge E of the guide 108'' as the web W is driven in the direction of arrow A1. In the embodiment of FIG. 7 the motor rotates in the opposite direction from the direction of rotation of the motor 500 in the embodiment of FIGS. 1 through 6.

If it is desired to change the position of the pinch point P or P1 which will thus change the respective vectors VR1 and VR2, or VR3 and VR4 this can be accomplished by loosening the screws 510 and shifting the bracket 509 longitudinally. The cutouts 512 are large enough so that the bracket 509 can also be shifted laterally. Upon movement of the bracket 509 to the selected position and tightening of the screws 510 the bracket 509 is secured in the selected position and thus the feed wheel 502 will be in the desired position relative to the roll 528.

Other embodiments and modifications of this invention will suggest themselves to those skilled in the art, and all such of these as come within the spirit of this invention are included within its scope as best defined by the appended claims.

I claim:

1. Apparatus for feeding a longitudinally extending record having opposite faces terminating at side edges, comprising: an edge guide, a rotatable feed wheel having a rotational axis and having a frictional surface rotatable in a plane perpendicular to the rotational axis, a roll cooperable with the frictional surface to provide a pinch point disposed either upstream longitudinally of the rotational axis and laterally between the rotational axis and the edge guide or downstream longitudinally of the rotational axis and beyond the rotational axis, and means for driving the feed wheel to feed the record longitudinally in guided relationship with the edge guide.

2. Apparatus as defined in claim 1, including a frame, wherein the driving means comprises an electric motor having a drive shaft to which the feed wheel is secured, the frame including a guide plate for guiding the record to the feed wheel, a cutout in the plate, the feed wheel being disposed at the cutout, and means for mounting the electric motor to the frame.

3. Apparatus as defined in claim 1, including a frame, wherein the driving means includes an electric motor, means for pivotally mounting the electric motor to the frame, and means for urging the electric motor in one direction to cause the feed wheel to press the record against the roll.

4. Apparatus as defined in claim 1, including a frame, wherein the driving means includes an electric motor, means for pivotally mounting the electric motor to the frame, and means for urging the electric motor in one direction to cause the feed wheel to press the record against the roll, wherein the urging means comprises a counterweight and a light spring.

5. Apparatus as defined in claim 1, including a frame, wherein the driving means includes an electric motor, means for pivotally mounting the electric motor to the frame, and means for urging the electric motor in one direction to cause the feed wheel to press the record against the roll, and means for pivoting the electric motor and the feed wheel which it carries to move the feed wheel and the roll relatively apart to enable the record to be inserted between the roll and the feed wheel.

6. Apparatus as defined in claim 1, including a frame, wherin the driving means comprises an electric motor having a drive shaft to which the feed wheel is secured, and means for adjustably mounting the motor to the frame to enable adjustment of the position of the feed wheel relative to the roll.

7. Apparatus as defined in claim 1, wherein the driving means comprises a stepping motor coupled to the feed wheel.

8. Apparatus as defined in claim 1, wherein the frictional surface comprises a narrow annular ring having serrations.

9. Apparatus for feeding a longitudinally extending record having opposite faces terminating at side edges, comprising: a frame, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means comprises an electric motor having a drive shaft to which the feed wheel is secured, the frame including a guide plate for guiding the record to the feed wheel, a cutout in the plate, the feed wheel being disposed at the cutout, and means for mounting the electric motor to the frame.

10. Apparatus for feeding a longitudinally extending record having opposite faces terminating at side edges, comprising: a frame, a roll mounted by the frame, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means includes an electric motor, means for pivotally mounting the electric motor to the frame, and means for urging the electric motor in one direction to cause the feed wheel to press the record against the roll.

11. Apparatus for feeding a longitudinally extending record having opposite faces terminating at side edges, comprising: a frame, a roll mounted by the frame, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means includes an electric motor, means for pivotally mounting the electric motor to the frame, and means for urging the electric motor in one direction to cause the feed wheel to press the record against the roll, wherein the urging means comprises a counterweight and a light spring.

12. Apparatus for feeding a longitudinally extending record having opposite faces terminating at side edges, comprising: a frame, a roll mounted by the frame, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means includes an electric motor, means for pivotally mounting the electric motor to the frame, and means for urging the electric motor in one direction to cause the feed wheel to press the record against the roll and means for pivoting the electric motor and the feed wheel which it carries to move the feed wheel and the roll relatively apart to enable the record to be inserted between the roll and the feed wheel.

13. Apparatus for feeding a longitudinally extending record having opposite faces terminating at side edges, comprising: a frame, a roll mounted by the frame, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means comprises an electric motor having a drive shaft to which the feed wheel is secured, and means for adjustably mounting the motor to the frame to enable adjustment of the position of the feed wheel relative to the roll.

14. Apparatus for feeding a longitudinally extending record having opposite faces terminating at side edges, comprising: a frame, the frame including means for supporting the record for movement along a path, and means providing an interruption in the supporting means, the feed wheel being disposed at the interruption, an edge guide, a rotatable feed wheel having a rotational axis and having a frictional surface rotatable in a plane perpendicular to the rotational axis, means for mounting the feed wheel to exert a resultant drive force on the record when driven comprised of a vector of large magnitude extending in the longitudinal direction for feeding the record longitudinally and a vector of small magnitude extending in a lateral direction for causing the record to be driven laterally to cause its side edge to be in guided contact with the edge guide, the frictional contact between the feed wheel and the face of the record being such as to cause slippage between the frictional surface and the face of the record to prevent the record from buckling laterally, and means for driving the feed wheel, wherein the driving means comprises an electric motor having a drive shaft to which the feed wheel is secured, and means for mounting the electric motor to the frame.

15. Apparatus for feeding a record having opposite faces terminating at side edges, comprising: an edge guide, means for supporting the record for movement along a longitudinal path, a rotatable feed wheel having a rotational axis and having a frictional surface rotatable in a plane generally perpendicular to the rotational axis, a back-up member, means mounting the feed wheel and the back-up member adjacent the path to provide a pinch for the record, with the pinch point being disposed either upstream longitudinally of the rotational axis and laterally between the rotational axis and the edge guide or downstream longitudinally of the rotational axis and laterally beyond the rotational axis so that the frictional surface of the feed wheel and the back up member are in contact with opposite faces of the record to exert a resultant drive force on the record comprised of a force vector of large magnitude extending in the longitudinal direction for feeding the record longitudinally and a force vector of small magnitude extending in the lateral direction for driving the record laterally to cause its side edge to be in guided contact with the edge guide with concomitant slippage between the frictional surface and the face of the web to prevent the record from buckling laterally, the pinching force exerted on the record at the pinch point being high relative to the force exerted by the feed wheel at other than the pinch point, and means for driving the feed wheel.

16. Apparatus as defined in claim 15, wherein the driving means comprises a stepping motor coupled to the feed wheel.

17. Apparatus as defined in claim 15, wherein the frictional surface comprises a narrow annular ring having serrations.

18. Method of feeding a record having opposite faces terminating at side edges, comprising the steps of: supporting the record for movement along a path, providing an edge guide adjacent the path, providing a rotatable feed wheel having a rotational axis and having a frictional surface in a plane perpendicular to the rotational axis, bringing the record between a pinch point provided by the frictional surface and an opposed back-up member, the pinch point being disposed either upstream longitudinally of the rotational axis and laterally between the rotational axis and the edge or downstream longitudinally of the rotational axis and laterally beyond the rotational axis so that the frictional surface of the feed wheel and the back-up member are in contact with opposite faces of the record to exert a resultant drive force on the record comprised of a force vector of large magnitude extending in the longitudinal direction for feeding the record longitudinally and a force vector of small magnitude extending in the lateral direction for driving the record laterally to cause its side edge to be in guided contact with the edge guide with concomitant slippage between the frictional surface and the face of the web to prevent the record from buckling laterally, and driving the feed wheel to feed the record longitudinally in guided relationship with the edge guide.

* * * * *

UNITED STATES PATENT AND TRADEMARK OFFICE

CERTIFICATE OF CORRECTION

PATENT NO. : 3,968,917

DATED : July 13, 1976

INVENTOR(S) : John H. Lanahan

It is certified that error appears in the above-identified patent and that said Letters Patent are hereby corrected as shown below:

Column 4, line 56, "pins" should be --pin--. Column 10, line 2, after "edge" --guide-- has been omitted.

Signed and Sealed this

Nineteenth Day of October 1976

[SEAL]

*Attest:*

RUTH C. MASON
*Attesting Officer*

C. MARSHALL DANN
*Commissioner of Patents and Trademarks*